US007134855B2

(12) United States Patent
Bohr

(10) Patent No.: US 7,134,855 B2
(45) Date of Patent: Nov. 14, 2006

(54) VANE PUMP WITH INTEGRATED SHAFT, ROTOR AND DISC

(75) Inventor: William J Bohr, Georgetown, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/460,973

(22) Filed: Jun. 13, 2003

(65) Prior Publication Data

US 2004/0253134 A1 Dec. 16, 2004

(51) Int. Cl.
*F04C 2/00* (2006.01)

(52) U.S. Cl. ..... 418/259; 418/133; 418/268

(58) Field of Classification Search ..... 418/259, 418/133, 139, 131, 260, 268, 11
See application file for complete search history.

(56) References Cited

U.S. PATENT DOCUMENTS

| | | | | | |
|---|---|---|---|---|---|
| 1,507,611 | A | * | 9/1924 | Leigh | 418/136 |
| 1,974,112 | A | | 9/1934 | Johnson | |
| 5,431,552 | A | * | 7/1995 | Davis et al. | 418/268 |
| 5,613,846 | A | * | 3/1997 | Sommer | 418/11 |
| 6,030,191 | A | * | 2/2000 | Wood et al. | 418/181 |
| 6,030,195 | A | * | 2/2000 | Pingston | 418/133 |
| 6,033,196 | A | * | 3/2000 | Schuller et al. | 418/133 |

FOREIGN PATENT DOCUMENTS

| | | |
|---|---|---|
| GB | 743 088 | 1/1956 |
| JP | 53 111511 | 9/1978 |
| JP | 60 113085 | 6/1985 |
| JP | 01 177478 | 7/1989 |
| JP | 02 185687 | 7/1990 |
| JP | 2002 221164 | 8/2002 |

OTHER PUBLICATIONS

Case 20A PCT Written Opinion (PCT/ISA/237 –6 Sheets).
Case 20A PCT –International Search Report (PCT/ISA /210 –5 sheets).

* cited by examiner

*Primary Examiner*—Theresa Trieu
(74) *Attorney, Agent, or Firm*—Flynn, Thiel, Boutell & Tanis, P.C.

(57) ABSTRACT

A rotary vane suction pump that includes a housing that defines a pump chamber. A shaft is rotatably mounted to the housing. A rotor is fixed to the front end of the shaft to rotate in unison with the vanes. The vanes that form the fluid cavities, into which the fluid is drawn into and discharged from, are seated in radially directed slots that extend longitudinally, end-to-end along the length of the rotor. Discs located at the opposed inboard and outboard ends of the rotor are mounted to the shaft and rotor to turn in unison with the rotor. The discs have diameters greater than that of the rotor and the pump chamber. The discs thus close the ends of the pump chamber and the ends of the slots in which the vanes are seated.

21 Claims, 7 Drawing Sheets

VANE PUMP WITH INTEGRATED SHAFT, ROTOR AND DISC

FIELD OF THE INVENTION

This invention relates to a rotary vane, positive displacement pump. In particular, this invention relates to a rotary vane, positive displacement pump that has a rotor that can be dimensioned essentially independently of the shaft to which the rotor is attached.

BACKGROUND OF THE INVENTION

Positive displacement pumps are used in a number of different industrial and commercial processes to force fluid movement from a first location to a second location. One type of positive displacement pump that is often used when such fluid transport is required is the rotary vane pump. A rotary vane pump includes a housing, a section of which is shaped to define a pump chamber. Often, the pump chamber has an eccentric, non-circular cross-sectional profile. In prior art pumps of this type, flat, stationary discs define the front and rear ends of the chamber. A shaft extends through the housing. Attached to the shaft is a rotor that is inwardly spaced relative to the inner wall of the casing that defines the pump chamber. Vanes extend outwardly from slots in the rotor. As the shaft and rotor turn, the volume of the space in the chamber between adjacent vanes and the opposed surfaces of the rotor and housing, referred to as a fluid cavity, cyclically increases and decreases. As a result of the volume of a fluid cavity increasing, a suction is formed in the cavity. The suction draws fluid into the fluid cavity through an inlet opening. As the rotor continues to turn, owing to the geometry of the pump chamber, the volume of the fluid cavity decreases. As a result of the volume of the cavity decreasing, the fluid in the cavity is discharged through an outlet opening.

At any given moment during the actuation of a rotary vane pump, the section of the rotor adjacent where the fluid is being discharged is subjected to a pressure force. The other arcuate sections of the pump are not subjected to like stress. In other words, during the normal operation of a rotary vane suction pump, the pump rotor and, more significantly, the shaft to which the rotor is attached, is subjected to uneven, asymmetric, loading. It is presently common practice to rotatably suspend the pump shaft in the associated casing with two spaced apart bearing assemblies. The rotor is mounted over the shaft so as to be located between the bearing assemblies. More specifically the portion of the shaft to which the rotor is mounted is referred to as the hub. The pressure load on the rotor is transmitted through the hub and the opposed ends of the shaft to the bearing assemblies.

As a consequence of the above arrangement, the size of the rotor is, to a significant extent, linked to the size of the shaft to which the rotor is mounted. This relationship can sometimes lead to design disadvantages. For example, in order to minimize the unit area shaft stress, a specific sized shaft is needed in order to provide a pump capable of being exposed to a specific maximum pressure load. An inherent consequence of increasing shaft size, shaft diameter, is that the size, diameter, of the associated rotor also increases. In order to provide the desired internal velocity of the fluid cavities, it is typically necessary to rotate these shaft-rotor assemblies at relatively slow speeds. This typically results in having to provide a speed reducer assembly between the motor used to drive the pump and the associated pump shaft.

Still another consequence of providing a pump of the above design is that it requires the placement of dynamic seals around both ends of the rotor. Providing two of these seals adds to the costs of both constructing and maintaining the pump.

SUMMARY OF THE INVENTION

The invention is related to a new and useful rotary vane, positive displacement pump. The pump of this invention has a rotor that is attached to the front end of the complementary shaft. An inboard disc is located between the rotor and shaft to form a first end surface against which the pump vanes seat. An outboard disc may be fitted over the opposed end, the front end, of the rotor to form the second end surface against which the vanes seat. Both discs rotate in unison with the rotor and the shaft.

In some versions of the invention, the shaft, rotor and discs are separate components. In some embodiments of these versions of the invention, a single bolt is used to secure these components together.

An advantage of the pump of this invention is that the shaft and rotor can be sized independent of each other. One benefit of the design freedom this invention provides is that, for a given size rotor, the pump of this invention pumps a relatively large volume of liquid. Consequently, in comparison to known pumps, a pump of this invention can pump the same volume of liquid with a relatively small rotor that is driven at a relatively high speed. Since the pump of this invention is run at high speeds, often there is no need to provide a speed reducing gear assembly between the pump and the associated drive motor.

Since the shaft of the pump of this invention does not have a forward end, there is no need to provide a forward end seal. The elimination of this eliminates the associated costs of both providing it and maintaining it.

BRIEF DESCRIPTION OF THE DRAWINGS

The invention is pointed out with particularity in the claims. The above and further features and advantages of the invention are described by the following detailed description taken in combination with the accompanying drawings in which:

DETAILED DESCRIPTION

Figure 1:
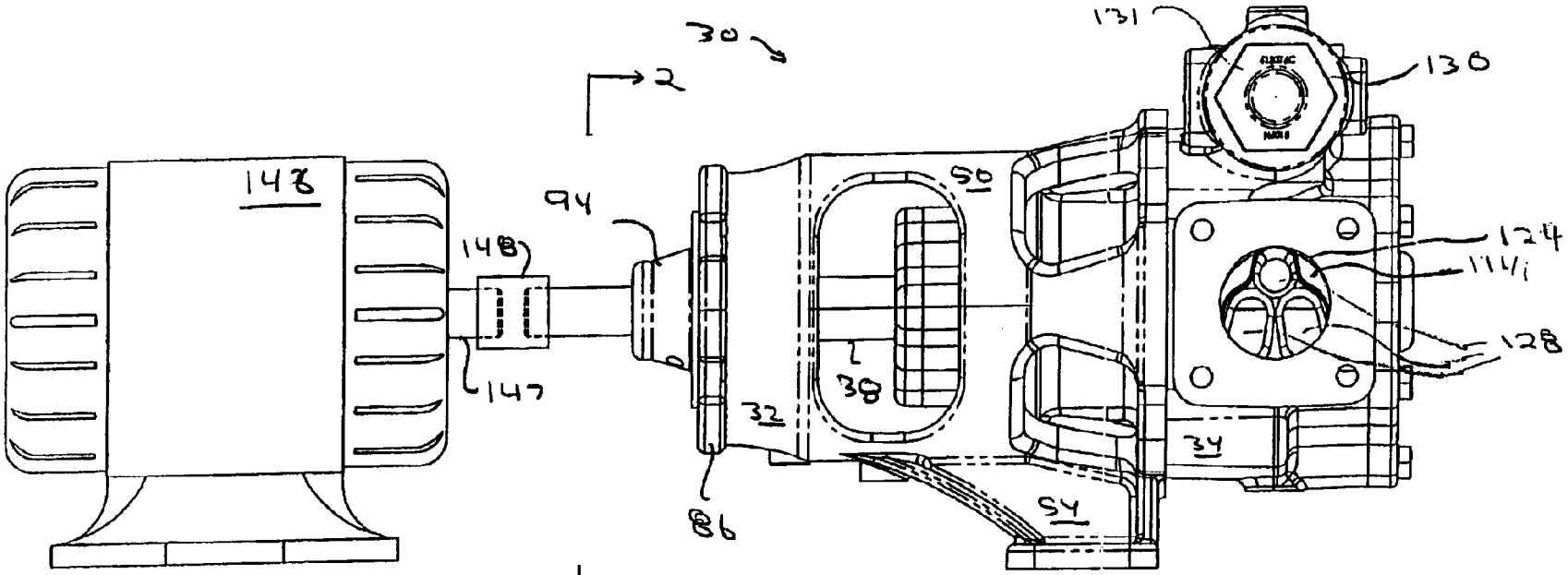
FIG. 1 is a side view of a rotary vane pump of this invention.
Figure 2:
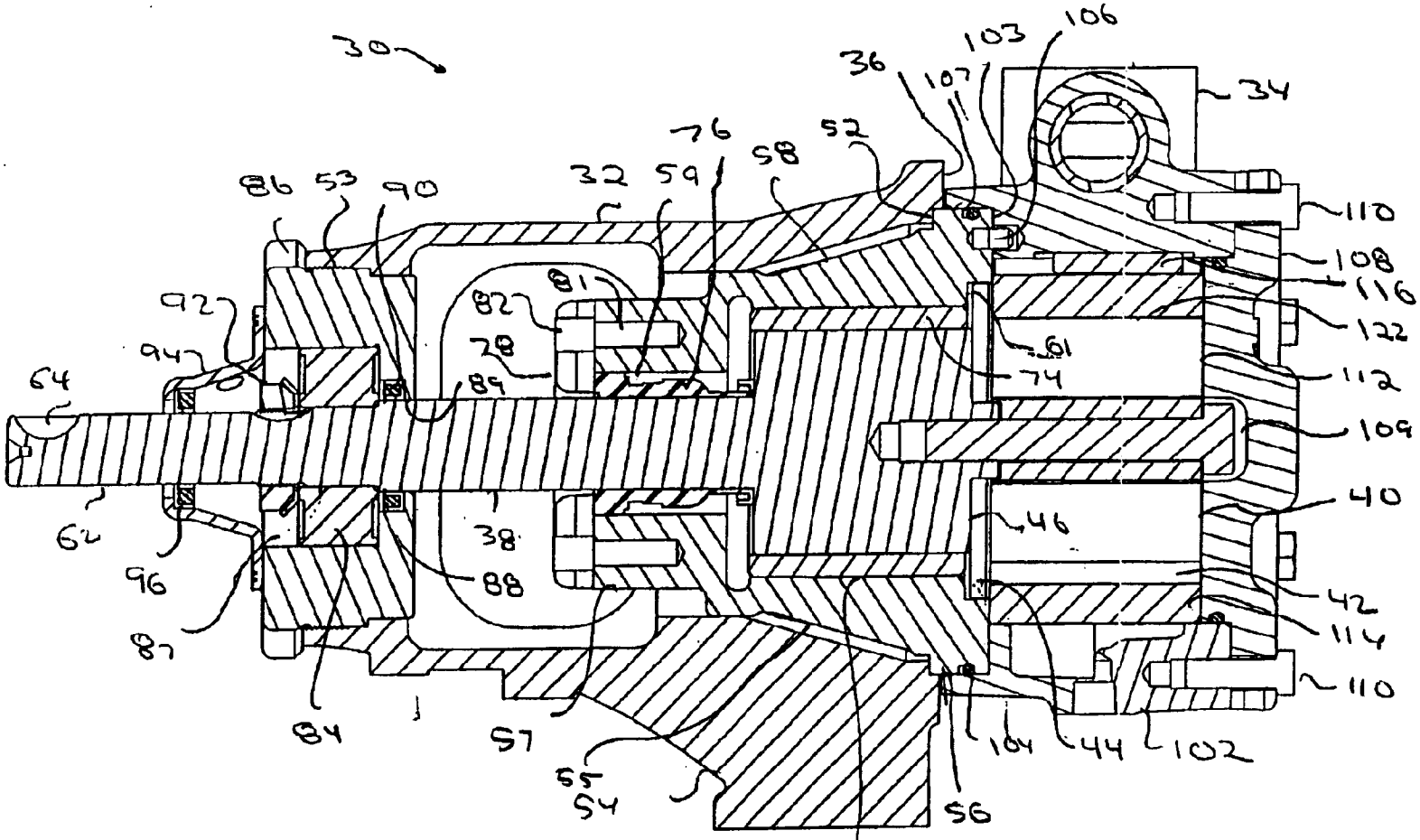
FIG. 2 is a cross-sectional view of the rotary vane suction pump taken along line 2—2 of FIG. 1.

FIGS. 1 and 2 illustrate a rotary vane suction pump 30 constructed in accordance with this invention. Pump 30 includes an elongated drive housing 32. A pump casing 34 is fitted over one end of the drive housing 32, for purposes of reference, the drive housing front end 36. A shaft 38 is rotatably fitted in drive housing 32. A rotor 40 is secured to the shaft 38 and is located forward of the drive housing front end 36. More particularly, rotor 40 is located in the pump casing 34 and, still more specifically, within a pump chamber 42 defined by the pump casing. The rotor 40 is formed with slots 41 which surround a central portion 40A of the rotor and in which vanes 43 are seated (slots and vanes seen in FIG. 6). An inboard disc 44 is located between rotor 40 and a front face 46 of shaft 38. Inboard disc 44 rotates with the shaft 38 and rotor 40.

Drive housing 32 has an elongated body 50 that has a generally circular cross-sectional profile. The body 50 is generally open from the front end 36 to an opposed rear end 53. A foot 54 extends downwardly from body 50 to hold the drive housing 32, as well as the rest of the pump 30, above ground level and to secure the pump in place.

A static inboard head 55 is seated in the open portion of the drive housing so as to extend rearwardly from the front end 36. More particularly, in the illustrated version of the invention, inboard head 55 has a base 57 that has a constant circular cross-sectional profile. Extending forward from the base 57, inboard head 55 has a front section 58 with a generally conical shape. A lip 56 of constant diameter extends forward from front section 58.

The drive housing body 50 is formed with an inner wall with a first section that has a diameter that corresponds to the outer diameter of the inboard head base 57. Extending forward from the inner wall first section the drive housing body inner wall has a second section with a frusto-conical profile and a diameter greater than that of inboard head base 57. A counterbore 52 extends around the open ended front end 36 of the drive housing 32.

When the inboard head 55 is fitted in the drive housing 32, the inboard head base 57 is closely slip fitted against the adjacent first section of the inner wall of the drive housing. The inboard head front section 58 is spaced a slight distance away from the adjacent surrounding second section of the inner wall of the drive housing. Inboard head lip 56 seats in counterbore 52 of the drive housing 32. In the depicted version of the invention, drive housing 32 and inboard head 55 are collectively dimensioned so that the inboard head lip 56 extends forward a short distance from the housing front end 36.

Inboard head 55 is further formed to have two axially aligned bores that form a through path through the inboard head. Bore 59 extends forward from the rearwardly directed end of base 57. Bore 60 extends from bore 59 through the head front section 58 to the front face of the head 55. Bore 60 has a diameter larger than the diameter of bore 59. Inboard head 55 is further formed to have a counterbore 61 in the front end of front section 58 that surrounds bore 60.

Figure 3:
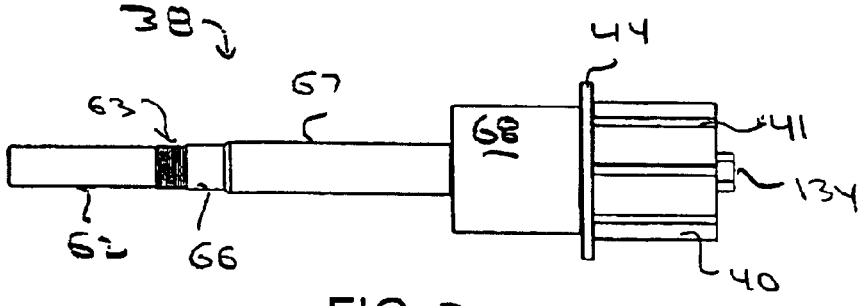
FIG. 3 is a side view of the shaft-disc-rotor subassembly of the pump of this invention.
Figure 4:
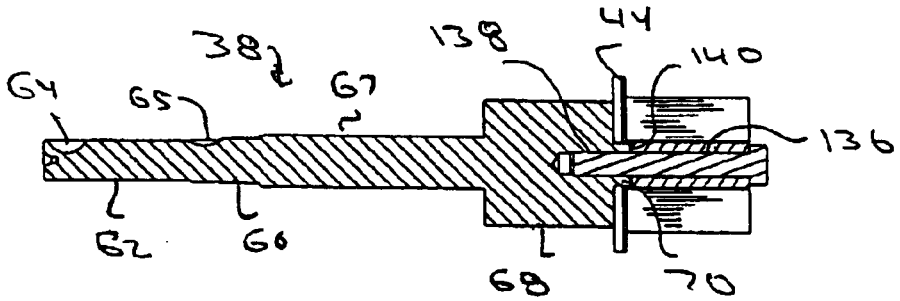
FIG. 4 is a cross-sectional view of the shaft-disc-rotor subassembly.

Shaft 38, now described by reference to FIGS. 3 and 4, is an elongated cylindrical structure with a number of sections with different diameters. The shaft 38 has a tail 62 that forms the rear end of the shaft. The most forward portion of tail 62 is provided with threading 63 for purposes to be explained below. Two recesses, keyways 64 and 65 are also formed in the shaft. Keyway 64, the keyway located at the end of the shaft, is provided to facilitate the coupling of the shaft to the output shaft of a motor (motor and shaft in FIG. 1) used to actuate the pump 30. Keyway 65 is formed in the portion of the shaft tail 62 on which threading 63 is formed.

Immediately forward of tail 62, shaft 38 is shaped to have an intermediate section 66. Intermediate section 66 has a diameter greater than that of tail 62. Forward of intermediate section 66, shaft 38 has a neck 67. Neck 67 has a diameter greater than that of intermediate section 66 and is substantially longer in length than the intermediate section. Shaft 38 is further formed to have a head 68 located forward of neck 67. Head 68 has a diameter greater than that of the neck 67. Extending forward from head 68, the shaft has a relatively short nose 70. Nose 70 has a relatively small outer diameter, less than that of tail 62.

Returning to FIG. 2, it can be seen that the shaft 38 is rotatably held in the drive housing body 50 by a front bearing assembly 74. In the depicted version of the invention, bearing assembly 74 is a single piece, sleeve shaped journal bearing. This journal bearing is formed from low friction material such as carbon. The journal bearing extends from the inner wall of inboard head 55 that defines bore 60 to shaft head 68. Alternative assemblies, such as a roller bearing assembly, may be employed as the bearing assembly 74.

It should also be understood that inboard head 55 and bearing assembly 74 are formed so that there is a void space in bore 60 behind the bearing assembly.

Bearing assembly 74 is a product lubricating bearing assembly. In other words, a small fraction of the material that is forced through the pump is supplied to bores 59 and 60 to lubricate the bearing assembly. This material is supplied to the bearing assembly 74 through a small channel or channel formed in the inboard head, (channels not illustrated). These channels extend from the pump chamber through the pump casing 34 and inboard head 55 into the void space behind the bearing assembly 74.

A shaft seal 76 is disposed in inboard head bore 59. Seal 76 abuts the portion of the shaft neck 67 adjacent shaft head 68 and extends rearwardly through bore 59. A ring-shaped seal cover 78 is secured over the rearward facing end of inboard head base 57 to hold the seal 76 in position. Complementary bores 81 and 82 are provided in the inboard head base 57 and cover 79, respectively, to accommodate fasteners that hold the cover to inboard head 55. When the cover 78 is so secured, the cover compresses seal 76 so that the seal abuts both the shaft 38 and the inner wall of the inboard head base 57 that defines bore 59. Thus, seal 76 prevents flow of the product being pumped rearwardly beyond the inboard head 55.

A second, rear bearing rotatably holds the shaft intermediate section 66 to drive housing 32. More particularly, a circularly shaped bearing adjuster 86 is fitted in the open rear end 53 of the drive housing 32. The bearing adjuster 86 is threadedly secured in the drive housing 32 so that the position of the bearing adjuster can be selectively positioned relative to the drive housing, (threaded surfaces on the drive housing and the bearing adjuster not identified). Bearing adjuster 86 is formed with an axially extending through bore. More specifically, the bore has a first section 87 that extends forward from the rear end of the bearing adjuster 86 through most of the bearing adjuster 86. The bore has a second section, section 88, that is both shorter in length than section 87 and smaller in diameter. The third and last section of the bore is an opening 89 formed in the front end of the bearing adjuster 86. Opening 89 is smaller in diameter than bore section 88 and slightly larger in diameter than the portion of the shaft neck 67 that extends through the opening 89. The forward portion of the shaft tail 62, the shaft intermediate section 66 and the rear portion of the shaft neck 67 extend through the bearing assembly bore.

Bearing assembly 84 is seated in bore section 87 and more particularly against the stepped surfaces between bore sections 87 and 88. The inner race of bearing assembly 84 seats against shaft intermediate section 66. The outer race of the bearing assembly 84 seats against the inner wall of the bearing adjuster 86 that defines bore section 87. A grease seal 90 is fitted in bore section 88. Grease seal 90 prevents the material used to lubricate bearing assembly 84 from flowing forward along the shaft 38.

A bearing cover 94 generally has a frusto-conical outer profile, is attached to the rear end of the bearing adjuster 86. Bearing cover 94 thus surrounds the portion of the shaft tail 62 that extends out of the bearing adjuster. A grease seal 96 is seated in the most rearward portion, the narrow diameter end of bearing cover 94. Grease seal 96 thus prevents the material used to lubricate bearing assembly 84 from flowing rearwardly along shaft 38.

While not shown, in some preferred versions of the invention, the bearing cover 94 is formed with a ring that seats against the outer race of bearing assembly 84. The outer race of the bearing assembly 84 is thus captured between the bearing adjuster and the bearing cover 94.

A lock nut 92 is fitted over and engages shaft threading 63. Lock nut 92 is positioned on shaft tail 62 to abut the inner race of bearing assembly 84. Thus, bearing assembly 84 is compressed between the stepped surface of bearing adjuster 86 that is between bearing sections 87 and 88 and lock nut 92. A lock washer (not shown) integral with lock nut 92 engages in keyway 65 to hold the lock nut 92 in position.

Figure 5:
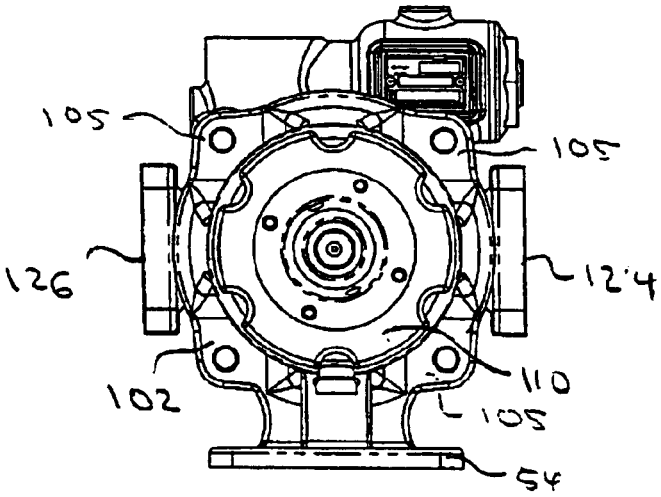
FIG. 5 is a view of the pump from the shaft end, the end of the pump to which the pump shaft is attached to the drive motor.

Pump casing 34, now described by reference to FIGS. 2 and 5, has a base 102 that is generally in the shape of an open cylinder. The rearward end of base 102 is shaped to define a counterbore 103. When the pump 30 of this invention is assembled, the pump casing 34 is positioned against the inboard head 55 so that the portion of the head that extends forward of the drive housing front end 36 seats in counterbore 103. An O-ring 104 fitted in a groove that extends around the outer surface of the inboard head lip 56 provides a seal between the pump casing 34 and the inboard head, (groove not identified). Pump casing 34 has four tabs 105 that extend outwardly from base 102. The tabs accommodate fasteners that are used to secure the pump casing 34 to the drive housing 32 (fasteners and complementary casing bores not shown).

A pin 106 is seated in complementary aligned bores in the pump casing 34 and inboard head 55. Pin 106 serves to both align the casing 34 when it is seated on the head 55 and prevent the rotation of the casing when pump 30 is actuated. The pin 106 also serves to hold the pump casing 34 in alignment with the inboard head 55 so that the channel(s) through which the product is supplied to the bearing assembly 74 to lubricate the assembly are in registration.

A disc-shaped cap 108 is seated over the forward open end of casing base 102. Threaded fasteners 110 removably secure the cap 108 to the base 102. In the depicted version of the invention, the cap 108 is formed with a disc shaped base 112 dimensioned to seat in the opening defined by the front end of pump casing base 102.

Pump casing base 102 and cap 108 define the space in which pump chamber 42 is located. More specifically, a liner 114 is fitted in the void space within base 102 to define the pump chamber 42. A key 116, with a square-shaped cross sectional profile, sits in complementary grooves 118 and 120 formed, respectively, in the casing base 102 and liner 114. Key 116 serves to accurately position the liner in the casing base 102. Liner 114 is further shaped to have an inner wall 122 that defines the outer circumferential perimeter of pump chamber 42. While liner 114 is shaped so that inner wall 122 is continuous, it is known to those skilled in the art that the wall 122 is shaped to provide the pump chamber with an eccentric, non-circular cross sectional profile. In the described version of the invention, rotor 40 and liner 114 share a common end-to-end size, referred to as width.

Complementary inlet and outlet ports 124 and 126, respectively, are formed in the pump casing base 102. Liner 114 is formed with inlet and outlet bores, that are, respectively, complementary to inlet port 124 and outlet port 126. FIG. 1, for example, illustrates that the particular liner of the described version of the invention is provided with three closely spaced inlet bores 128, (outlet bores not shown). The inlet and outlet ports and bores provide fluid communication paths to and from the pump chamber 42. The channel from which the product being pumped is bled off to lubricate bearing assembly 74 opens from an inner wall of the pump casing base 102 that defines outlet port 126.

While not illustrated, in some versions of the invention the outer surface of liner 114 may be formed with a recess that provides feedback flow from the outlet bores to the pump chamber. As discussed in Applicant's Assignee's U.S. Pat. No. 6,030,191, LOW NOISE ROTARY VANE SUCTION PUMP HAVING A BLEED PORT, issued 20 Aug. 1997, and incorporated herein by reference, this feedback reduces the noise generated during the actuation of the pump 30.

Pump casing base 102 is also provided with an auxiliary port 130. Port 130 houses a known in the art relief valve mechanism 131 that does not form any part of the present invention.

Figure 6:
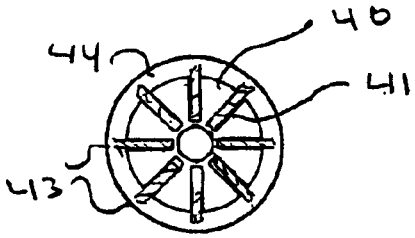
FIG. 6 is a front view of the of the shaft-disc-rotor subassembly.

Rotor 40 is disposed within pump chamber 42. The rotor 40, now described by reference to FIGS. 3, 4 and 6, is a generally solid, cylindrical shaped member. The rotor is secured to the shaft 38 by a single bolt 134. More particularly, bolt 134 extends through a bore 136 in rotor 40 and into a complementary threaded bore 138 in the shaft 38. Rotor 40 is further formed so as to have a counterbore 140 around the rearward facing face of the rotor, the face that abuts the shaft 38.

When pump 30 is assembled, inboard disc 44 is first seated over the shaft nose 70. While not identified, it should be understood that inboard disc 44 is formed with a center located opening to facilitate the above arrangement of components. Rotor 40 is placed over the disc 44 so that the shaft nose seats in counterbore 140. Bolt 134 is inserted through bore 136 and threadedly secured in bore 138. In some preferred versions of the invention, bolt 134 is secured to shaft 38 so that the bolt places a force on the rotor 40 and disc 44 that is approximately 10 times the lateral pressure force placed on the rotor as a result of the fluid transfer process.

Rotor 40 is formed with a number of equangularly spaced apart slots 41. Slots 41 extend radially inwardly from the outer perimeter of the rotor toward the center and extend end-to-end along the width of the rotor. Slots 41 do not, however, communicate with rotor bore 136, but rather extend out from the central portion 40A (FIG. 2) of the rotor 40. The vanes 43 of FIG. 6 are seated in slots 41 as part of the assembly of the pump. As seen in FIG. 2, the diameter of the central portion 40A of the rotor 40 is sequentially less than the diameter of the shaft 38 at the front bearing assembly 7A.

Once the shaft-disc-rotor subassembly is assembled, the subassembly is seated in the drive housing 32 and inboard head 55. As part of this process, lock nut 92 is fitted over the shaft tail 62 and cover 94 is bolted to the bearing adjuster 86. These steps serve to hold the shaft 38 in a fixed position relative to the bearing adjuster 86. Pump casing 34 is fitted over the drive housing front end 36 and the rotor 40. In order to facilitate the seating of the pump casing 34 over the rotor 40, it should be understood that the inner surface of cap 108 is formed with a small axially centered recess 109. The head of bolt 134 seats in recess 109. More particularly, recess 109 is formed so that, when the pump casing 34 is in position, the bolt head is spaced away from the adjacent surfaces of cap 108 that define recess 109.

It should also be understood that as a result of the seating of the shaft-rotor-disk subassembly, the inboard disc 44 seats in inboard head counterbore 61. Thus, the counterbore functions as an inlet disc chamber. When the pump casing and liner subassembly is fitted to the inboard head, this inlet disc chamber is in fluid communication with the pump chamber 42 and has a diameter greater than that of the pump chamber 42.

Once the pump casing 34 is secured, the position of the shaft-disc-rotor subassembly is set. First, the bearing adjuster 86 and cover 94 are rotated to move the bearing adjuster forward. This displacement of the bearing adjuster 86 causes a like displacement of the shaft 38 and bearing assembly 84. More specifically, these components are displaced in the forward direction until the outboard end of the rotor 40 abuts the adjacent inner surface of casing cap 108. Since the height of the rotor 40 and the liner 114 are the same, there is a like abutment of the inboard disc against the inwardly facing: surface of liner 114.

Bearing adjuster 86 is then adjusted to retract the shaft-disc-rotor subassembly rearwardly. More particularly, the shaft-disc-rotor subassembly is positioned so that the inboard disc 44 is spaced from the opposed surfaces of the inboard head and the pump casing-and-liner subassembly. In some versions of the invention, the preferred separation between the inboard disk 44 and the pump casing-liner sub assembly is between 0.005 and 0.010 inches. There can be a greater separation between the inboard disk 44 and inboard head 55.

Pump 30 is actuated by a motor 146, seen in FIG. 1. More particularly, pump shaft 38 is directly coupled to an output shaft 147 of the motor 146. A coupling member 148 connects the shafts so that the is shafts rotate in unison. A member integral with the coupling member 148 seats in keyway 64 to facilitate the mating of the coupling member to the pump shaft 38 (coupling member not shown).

The rotation of shaft 38 causes a like movement of rotor 40. Due to the shape of the pump chamber 42, and the positions of the rotor 40 and vanes 43, as a fluid cavity between adjacent vanes approaches the inlet bores 128, the size of the cavity increases. This results in a vacuum developing in the fluid cavity that results in fluid being drawn into this space. The continued rotation of the rotor 40 results in this particular fluid cavity decreasing in overall size. As a result of the decreasing size of the fluid cavity, when the fluid cavity moves adjacent the liner outlet bores, the fluid within it is discharged.

In the pump 30 of this invention, inboard disc 44 holds the vanes 43 in rotor slots 41. Inboard disc 44 also closes the ends of the individual fluid cavities. While there is no seal between the inboard disc and the liner or pump casing, given the close spacing of the inboard disc to these components, the suction and pressure loss through this spacing is minor and does not adversely affect the operation of the pump 30.

Rotor 40 of pump 30 is not fitted over the shaft 38 to which the rotor is mounted. Instead, rotor 40 is mounted to the front end of the shaft 38. Consequently, bore 136 is smaller in diameter than a bore that it is necessary to provide for a rotor designed for fitting over a shaft. Thus, in the pump of this invention, rotor 40 can be sized essentially independently of the size of shaft 38. In practical terms, since bore 136 is small in size, it is similarly possible to fabricate rotor so that the overall size, the outer diameter of the rotor, is likewise relatively small. In comparison to a pump with a larger sized rotor, the shaft and rotor of pump 30 are run at a higher speed in order to pump the same volume of fluid. This is because, owing to the difference in rotor size, the maximum size, fluid-holding volume of the individual fluid cavities of the pump of this invention is smaller than pumps with larger sized rotors.

For example, a pump 30 of this invention designed to pump fluids at a rate of 30 gal./min. may have a rotor 40 with an outer diameter of between 2.0 and 3.0 inches, a rotor bore 136 with a diameter between 0.375 and 0.675 inches and may be driven at speeds between 1,400 and 2,400 RPM. A pump 30 designed to pump fluids at a rate of 50 gal./min. may have a rotor 40 with an outer diameter of between 2.5 and 3.5 inches, a rotor bore 136 with a diameter of between 0.50 and 0.75 inches and may be driven at speeds between 1,150 and 1,800 RPM. An advantage of driving the shaft 38 and rotor 40 of the pump 30 at these relatively high rates of speed is that these are the speeds at which the motor 146 used to actuate the pump operates. Thus the pump 30 of this invention can be directly coupled to the output shaft 147 of the complementary motor. The need to provide a reducing gear assembly to drive the pump at a lower speed is eliminated.

Pump 30 of this invention is further constructed so that inboard disc 44 rotates with the adjacent rotor 40. Since these components rotate together, the overall wear of the inboard disc and the abutting vanes 43 is likewise reduced. Still another feature of this invention, is that it does not require a front end dynamic seal that would otherwise be required between the end of the shaft located forward of the rotor and the pump casing. Moreover, since the dimensions of rotor 40 are essentially independent of the dimensions of the shaft 38, this invention makes it possible to, when desirable, provide the rotor 40 with relatively long slots 41. The relatively long slots 41 can be used to provide the pump 30 with vanes 43 that, themselves, are relatively long in length. In some circumstances, long vanes offer wear advantages over shorter vanes.

It should similarly be appreciated that pump 30 is constructed so that rotor 40 and the liner 114 have the same overall width. Thus, during the process of manufacturing the components forming the pump, the same machining process can be used to manufacture the rotor 40 and liner 114. This facilitates the economical precision manufacturing of these components. Moreover, during the actual process of assembling the pump 30, it is a relatively easy task to, with the bearing adjuster 86, first set the rotor so it seats against cap 108 and then back it off the appropriate distance to provide the necessary clearance for the inboard disc 44. The ease with which this process can be performed serves to further facilitate the economical assembly of pump 30 of this invention.

Figure 7:
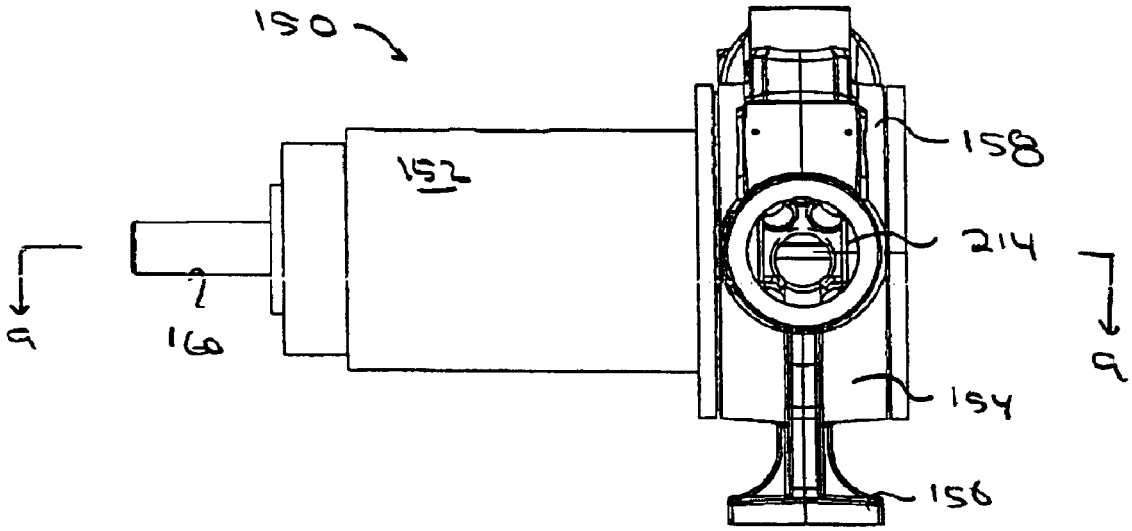
FIG. 7 is a side view of an alternative pump of this invention.
Figure 8:
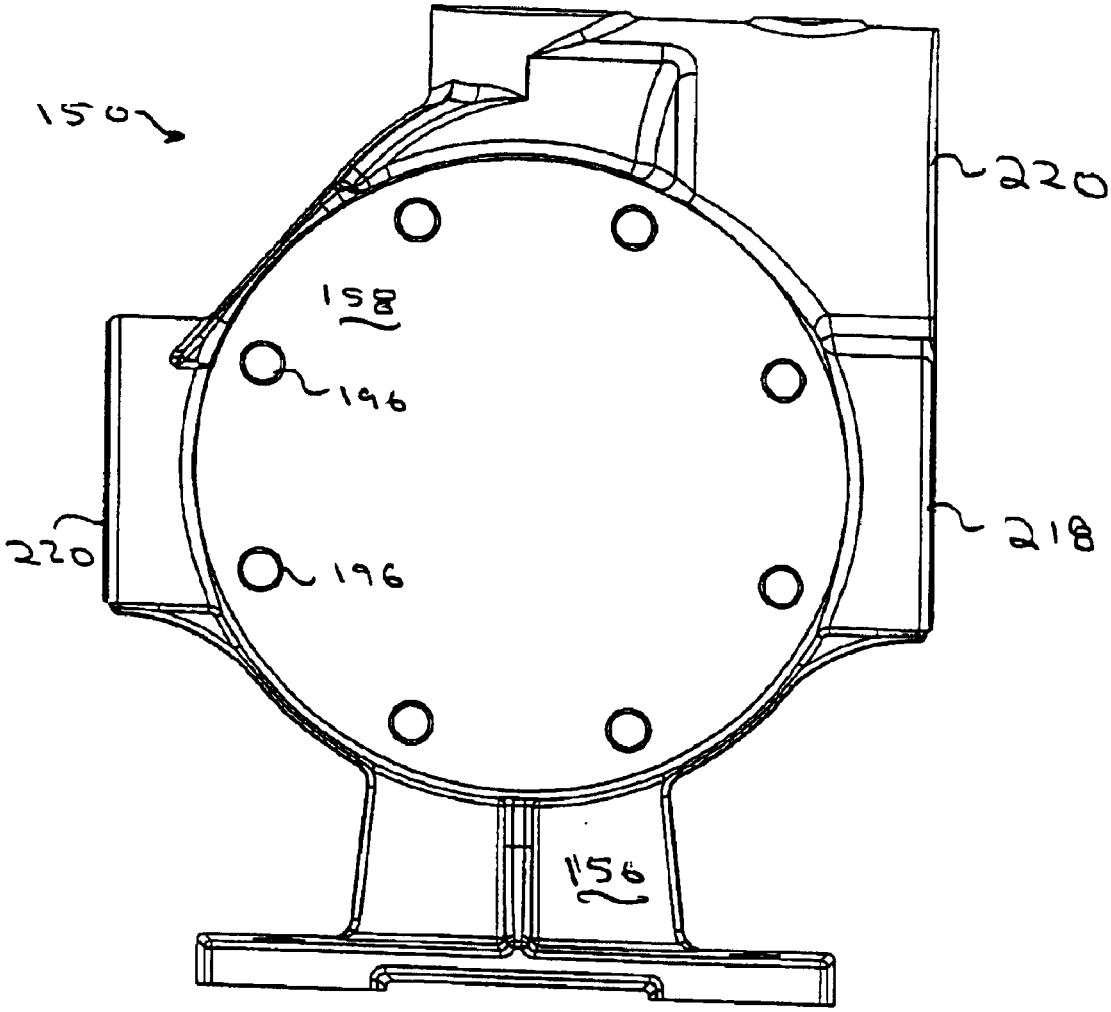
FIG. 8 is a front view of the alternative pump.
Figure 9:
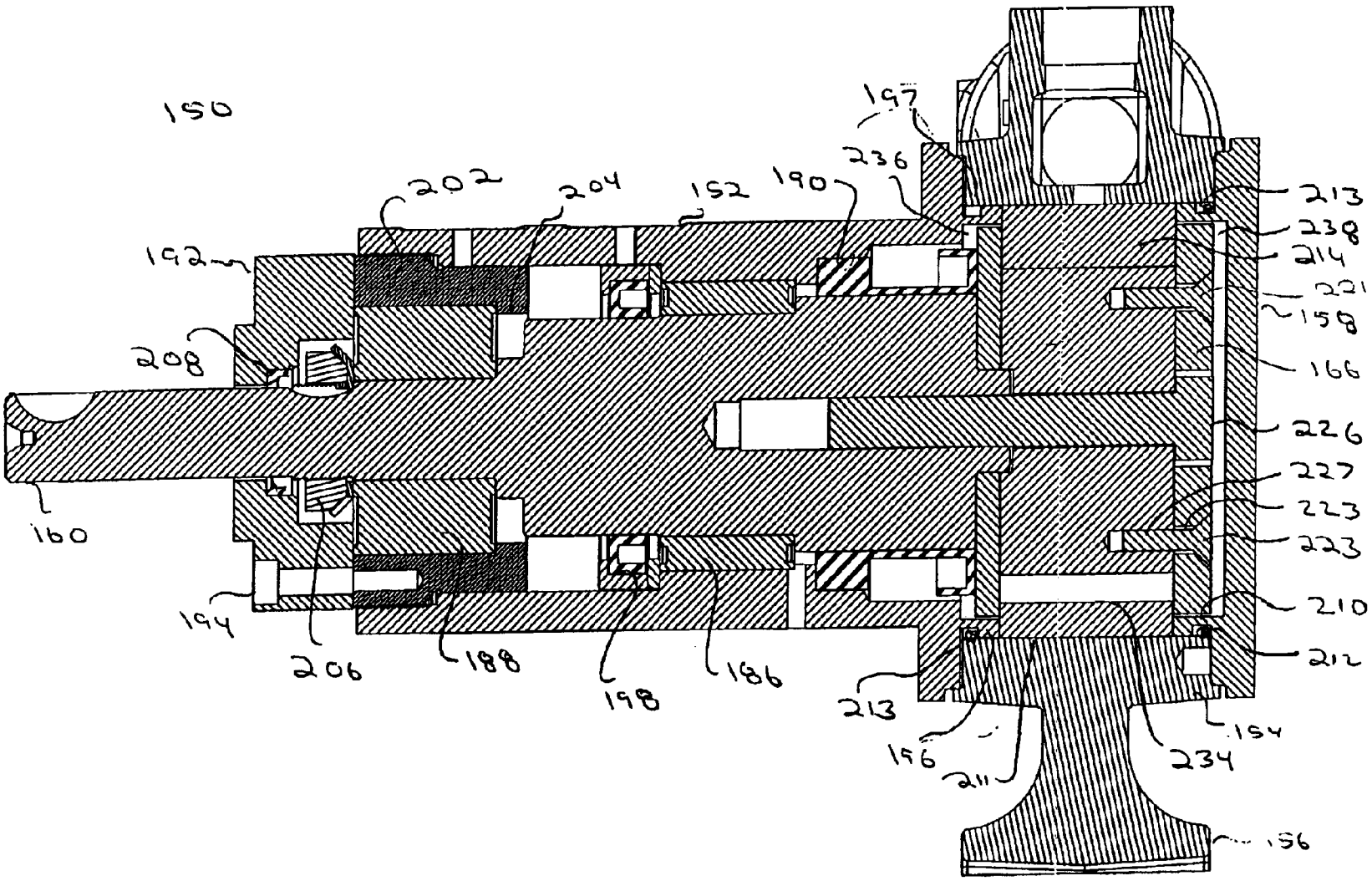
FIG. 9 is a cross-sectional view of the alternative pump taken along line 9—9 of FIG. 7.

FIGS. 7–9 illustrate an alternative pump 150 constructed in accordance with this invention. Pump 150 includes a generally cylindrical and hollow inboard head 152. A generally sleeve-shaped pump casing 154 is attached to the front end of the inboard housing 152. A foot 156 extends below that pump casing 154. Foot 156 holds the pump casing 154, as well as the other components forming pump 150, above ground level. The foot 156 also holds pump 150 in position. A disc shaped casing head 158 is secured over the open front end of pump casing 154.

Figure 10:
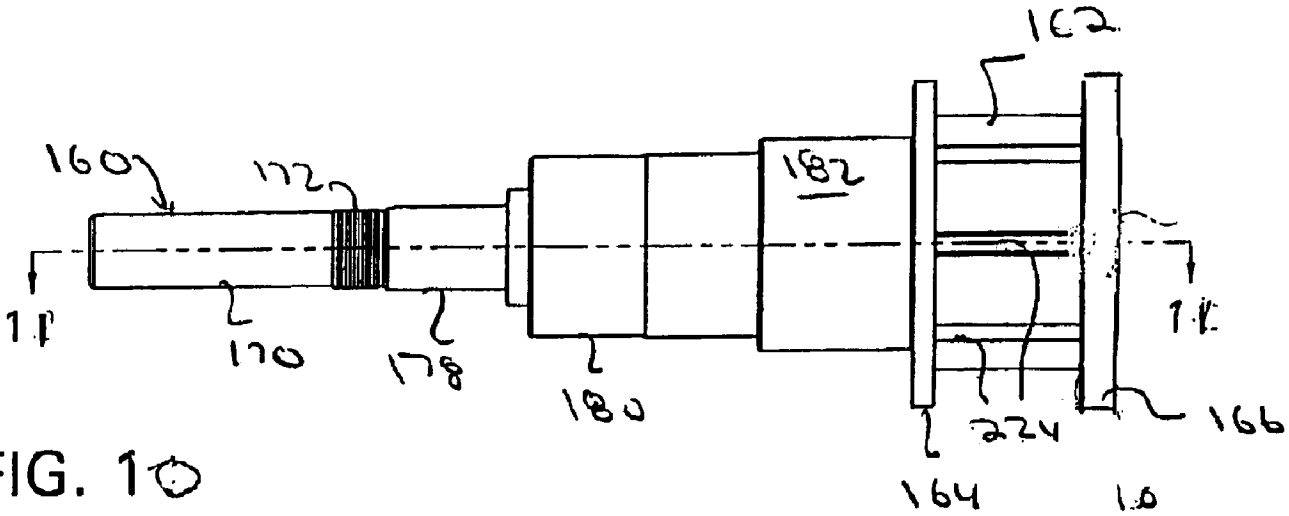
FIG. 10 is a side view of the shaft-disc-rotor-disc subassembly of the alternative pump.
Figure 11:
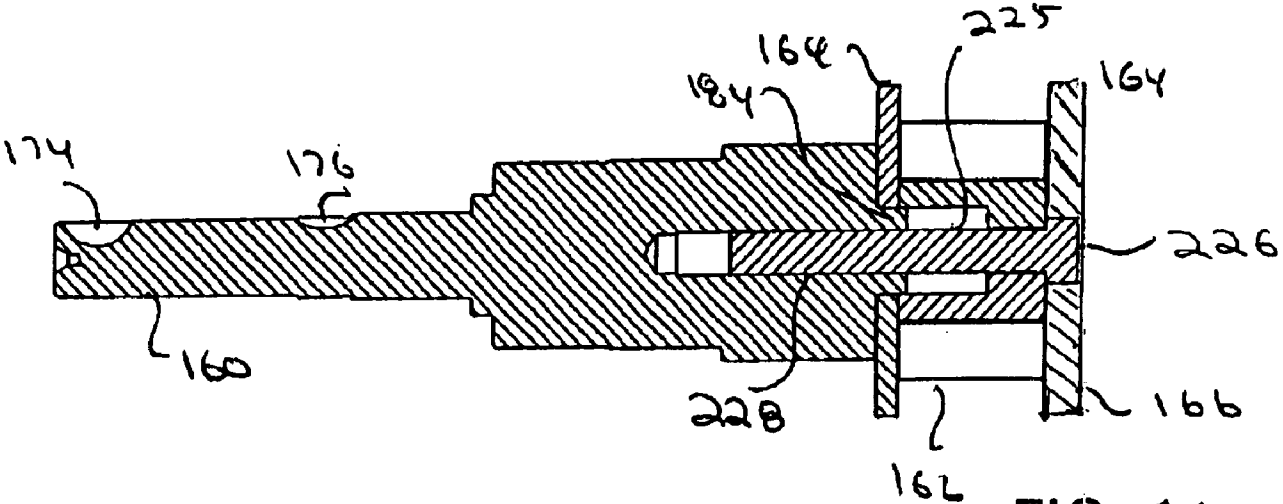
FIG. 11 is a cross-sectional view of the shaft-disc-rotor-disc subassembly taken along line 11—11 of FIG. 10.

A shaft 160, seen in FIGS. 10 and 11, is rotatably mounted in the inboard head 152. A rotor 162 is attached to the front end of the shaft 160 so as to rotate in unison with the shaft. An inboard disc 164 and an outboard disc 166 are located over, respectively, the rear and front ends of rotor 162. Discs 164 and 166, like rotor 162, turn in unison with shaft 160. Rotor 162 and discs 164 and 166 are located in pump casing 154.

Shaft 160 has an elongated tail 170. Tail 170 is formed to have a threading 172 and keyways 174 and 176 similar in shape and function that the threading 63 and keyways 64 and 65 of the first described shaft 38. A short length intermediate section 178 is located immediately forward of the portion of tail 170 on which threading 172 is formed. A relatively long neck 180 is located forward of intermediate section 178. A head 182 is in front of neck 180. A nose 184 extends forward from the front face of head 182. The tail 170, intermediate section 178, neck 180, head 182 and nose 184 have the same relative diameters as are present on the corresponding sections of shaft 38.

Returning to FIG. 9, it can be seen that two bearing assemblies 186 and 188 rotatably hold shaft 160 in inboard head 152. More specifically, bearing assembly 186, the more forward of the two bearing assemblies, extends between the shaft neck 180 and the surrounding inner wall of the inboard head 152. The inner race of bearing assembly 186 seats against the stepped surface between the shaft neck 180 and inboard head 152.

Bearing assembly 186 is not a product lubricating bearing assembly. A seal 190 is located between pump casing 154 and bearing assembly 186 to prevent fluid flow between these components. In FIG. 9, seal 190, for purposes of simplicity, is depicted as a single piece rubber seal. Actually, the; seal 190 may be a multi-component assembly. For example, it is contemplated that one version of seal 190 may be full convolution bellows type shaft seal. One version of this particular seal is the sold by the John Crane Company of Morton Grove, Ill. and Slough, United Kingdom as its Type 1 Elastomer Bellows Seal. Seal 190 extends between shaft head 182 and the adjacent inner wall of the inboard head 152 that defines the bore in which the shaft head 182 is seated.

A grease seal 198 extends around the rearward facing end of bearing assembly 186. Grease seal 198 is located in a bore section within the inboard head 152 that is larger in diameter than the bore section in which bearing assembly 186 is seated. Grease seal 198 bears against the adjacent inner wall of the inboard head 152 and the portion of the shaft neck the seal surrounds.

A bearing adjuster 202 is rotatably fitted in the open rear end of inboard head 152. Bearing assembly 188 extends between the shaft intermediate section 178 and the bearing adjuster 202. More particularly, the inner race of bearing assembly 188 is fitted over the shaft intermediate section 178. The inner race of bearing assembly 188 is fitted to shaft 160 to seat against the stepped surface between the shaft intermediate section 178 and the shaft neck 180. The outer race of bearing assembly 188 seats against the inner wall of bearing adjuster 202 that defines the through bore that extends through the bearing adjuster 202 (bore and wall not identified). Bearing adjuster 202 is formed with a forward-facing end that has a lip 204 that extends inwardly to surround the bore through the bearing adjuster. The forward-facing end of the outer race of bearing assembly 188 seats against the adjacent annular surface of lip 204.

A bearing cover 192 is secured of the rearwardly-directed face of the bearing adjuster 202 by threaded fasteners 194 (one fastener shown). The bearing cover 192 seats against the rearwardly directed face of the outer race of bearing assembly 188. Thus, the outer race of the bearing assembly 188 is trapped between bearing adjuster 202 and bearing cover 192.

A lock nut 206 is threaded onto shaft threading 172. Thus, the stepped surface of shaft 160 and lock nut 206 collectively cooperate to hold the inner race of the bearing assembly 188 in a fixed position over the shaft 160.

An annular grease seal 208 is fitted over the shaft tail 170 and is located immediately behind lock nut 206.

Threaded fasteners 196 (FIG. 8) secure the inboard case 152, the pump casing 154 and casing head 158 together. Returning to FIG. 9, it can be seen that the casing head 158 is formed to have a rearwardly directed annular lip 210 that seats in the outer perimeter of a center void 211 that extends through the pump casing 154. An O-ring 212, disposed in a groove 213 formed in the outer surface of lip 210, provides a seal between the adjacent surfaces of pump casing 154 and the casing head lip 210.

The rotor 162 and discs 164 and 166 are disposed in center void 211 of casing head 154. Also located in the center void 211 is a liner 214 similar in cross-sectional shape and function to previously described liner 114. Liner 214 is shorter in width than rotor 162. More particularly, in some versions of the invention, liner 214 is between 0.010 and 0.020 inches shorter in overall width than rotor 162.

It will be further observed that inboard head 152 is formed with a forward facing lip 196 that extends into the rearward end of casing head center void 211. An O-ring 213, fitted in a groove 197 formed around the outer surface of lip 196, provides a seal between the inboard head 152 and casing head 154.

It will further be observed that, when pump 150 is assembled, liner 214 is compressed between lip 196 of inboard head 152 and lip 210 of casing head 158. Lips 196 and 210 thus hold liner 214 in a static position within casing head center void 211.

Casing head 158 is shaped to have inlet, outlet and auxiliary ports 218, 220 and 222, respectively. Inlet, outlet and auxiliary ports, 218, 220 and 222 are similar in geometry and function to inlet, outlet and auxiliary ports 124, 126 and 130 of pump casing 34. Liner 214 has bores that perform the same function as the inlet outlet bores of the liner 114.

Rotor 162 is formed with outwardly directed equiangularly spaced apart slots 224 as seen in FIG. 11. Vanes 43 (FIG. 6) are seated in slots 224. A bore 225 extends through the longitudinal center axis of rotor 162. Bore 225 is provided to accommodate the seating of a bolt used to secure the rotor 162 to shaft 160 as is discussed below.

Inboard and outboard discs 164 and 166, respectively, have identical outer diameters. Both discs 164 and 166 have center-located through holes (holes not identified). The through hole formed in inboard disc 164 is larger in diameter than the through hole formed in outboard disk 166. More particularly, the through hole formed in inboard disc 164 is sized to facilitate the seating of the disc over shaft nose 184.

A set of threaded fasteners 221 secures the outboard disc 166 to rotor 162. More particularly, fasteners 221 are arranged in a circular pattern around the longitudinal center of the rotor and inboard disc 166. The fasteners extend through tapered bores 223 in the outboard disc 166 and complementary threaded bores 227 in the rotor 162.

A bolt 226 that extends through rotor 162 and inboard disc 164 secures these components to the front end of shaft 160. Bolt 226 is thus the threaded fastener that extends through rotor bore 225. Bolt 226 is seated in a threaded bore 228 formed in the shaft 160. In practice, shaft 160, rotor 162 and inboard disc 164 are first secured together by bolt 226. Outboard disk 166 is then secured over rotor 162 by fasteners 221. As a consequence of the fastening of the outboard disc 166 over the rotor 162, the head of bolt 226 is seated within the center bore that extends through the outboard disc 166.

When pump 150 of this embodiment of the invention is assembled, liner 214 is spaced inwardly from the opposed ends of the pump casing 154. The inner wall of liner 214 defines the pump chamber 234. Collectively, the pump casing head 154, the forward directed end of seal 190 and the rearward directed face of liner 214 define a void space, inboard disc chamber 236. The void space within the casing head lip 210 defines an outboard disc chamber 238. Both disc chambers 236 and 238 are in fluid communication with, and are larger in diameter than, the pump chamber 234.

When pump 150 is assembled, rotor 162 and vanes 43 are disposed within pump chamber 234. Inboard disc 164 is seated in inboard disc chamber 236; outboard disk 166 is seated in outboard disc chamber 23B. The bearing adjuster 202 is used to set the position of the shaft-rotor-inboard disc-outboard disc subassembly. More particularly, the position of this subassembly is set so that the inboard disc 194 and outboard disc 196 are equidistantly spaced from, respectively, the rearward and forward directed faces of liner 214. It should further be understood that, as a consequence of the dimensioning of the components of this invention, outboard disc 166 is spaced away from both the surrounding surfaces of the casing head 158 including the surrounding surfaces of lip 210. The head of bolt 226 is similarly spaced away from the adjacent inner surface of casing head 158.

Pump 150 operates in the same general manner as previously described pump 30. Pump 150 has the same advantages as pump 30.

An additional advantage of pump 150 is that outboard disc 166 forms the end surface against which vanes 43 abut. Inboard disc 164 rotates with shaft 160 and rotor 162 and, by extension, vanes 43. Thus, since outboard disc 166, like inboard disc 164, rotates in unison with the vanes 43, the rotation of the vanes does not wear into the discs.

It should be recognized that the above description is directed to two particular versions of the pump of this invention. Alternative versions of this invention may have constructions different from what has been described.

Clearly, the features of the two described versions of the pump can be combined as appropriate. Thus, it is within the scope of this invention to provide a pump with a product lubricated bearing assembly that has both inboard and outboard discs. Similarly, another version of this invention may have sealed bearing assemblies with just a single inboard disc. Also, there may even be versions of this invention without any rotating discs that close either end of the pump chamber. It may be desirable to construct another version of the invention with an outboard disc but not an inboard disc.

In the described version of the invention, the pumps are provided with two bearing assemblies. In some versions of the invention, it may only be necessary to provide a single bearing assembly that both rotatably holds the shaft in position and counterbalances the asymmetric loading to which the shaft and rotor are exposed. In other versions of the invention, three or more spaced apart bearing assemblies may be used to both rotatably hold the shaft in position and offset the loading to which the rotor is exposed. It should also be understood from the second disclosed embodiment of the invention that, it is not always necessary to fit the bearing assembly that counterbalances the asymmetric loading of the pump over the head end of the shaft, the end against which the rotor is mounted.

Also, there is no requirement that in all versions of the invention the shaft 38, the rotor 40 and the discs be separate components. It should be clear that the shaft, the inboard and outboard discs, and the rotor, or some combination of these components, can be formed from a single workpiece.

Also, it should likewise be recognized that in versions of the invention constructed from multiple parts, more than a single bolt may be used to secure the parts together. Thus, the arrangement of radial bolts described with respect to the second embodiment could extend through the rotor and inboard disc so as to secure these components to the head of the shaft. In some versions of the invention, a single bolt may be employed to secure the inboard and outboard disc and the rotor to the shaft. It should similarly be recognized that the shapes of the components described and illustrated in this specification are illustrative, not limiting.

Similarly, the inboard head and pump casing may have different constructions from what has been described. Thus, the pump casing is built into the pump housing. In these versions of the invention, the pump housing is a two-piece unit that forms two separate halves along a longitudinal plane. This construction facilitates the seating of the shaft, rotor, and inboard disc in the housing.

In the described versions of the invention, the inboard head and shaft are collectively dimensioned so that the front face of the shaft is not located a significant distance away from the front end of the inboard head. These depictions should be understood to be illustrative and not limiting. There may, for example, be alternative versions of the invention in which the front face of the shaft is located a significant distance in front of or behind the front end of the inboard head.

Also, while the pump of this invention is primarily used to pump liquid-state fluids, this use should not be considered limited. There may be systems in which it is desirable to incorporate the pump of this invention as a primer mover of gaseous-state fluids.

Thus, it is an object of the appended claims to cover all such variations and modifications as come within the true spirit and scope of this invention.

What is claimed is:

1. A suction pump comprising:

a drive housing having a front end;

a shaft rotatably disposed in said drive housing, said shaft having a front face located adjacent the front end of said drive housing;

a pump casing disposed over the front end of said drive housing, said pump casing defining a pump chamber that extends forward from the back face, the pump chamber having a diameter wherein, collectively the front end of said drive housing and said pump casing are shaped to define an inboard disc chamber that surrounds said pump chamber and has a diameter larger than the diameter of the pump chamber;

a rotor integrally attached to the front face of said shaft to rotate with said shaft, said rotor positioned in said pump chamber, said rotor having a plurality of circumferentially spaced apart radially directed slots, and a diameter;

a plurality of vanes disposed in said pump chamber, each said vane being disposed in a separate one of the slots formed in said rotor; and an inboard disc located between said shaft and said rotor so as to be located against the open end of said slots and secured to said shaft so as to rotate with said shaft and said rotor, said inboard disc having a diameter that is greater than the diameter of said rotor and being disposed in the inboard disc chamber, wherein, said disc is positioned to be spaced away from surfaces of said drive housing and said pump casing that define the inboard disc chamber.

2. The pump of claim 1, wherein said shaft is shaped to have:

a stem section located distal to said pump casing, the stem section having a diameter; and a head section located adjacent said pump casing, the head section having a diameter that is greater than the diameter of said stem section and wherein said inboard disc is disposed against the head section.

3. The pump of claim 2, further including a bearing assembly for rotatably holding said shaft in said drive housing, said bearing assembly extending from the head section of said shaft to said drive housing.

4. The pump of claim 1, wherein:

said shaft, said rotor and said inboard disc are separate components; and a fastener urges said rotor towards said shaft so that said inboard disc is compression secured between said shaft and said rotor.

5. The pump of claim 4, wherein:

said shaft is shaped to have a boss that extends forward from the front face of said shaft; and said rotor and said shaft are seated on said shaft boss.

6. The pump of claim 1, wherein:

said pump casing is shaped to define an outboard disc chamber that is located forward of said pump chamber and that has a diameter greater than the diameter of said pump chamber; and an outboard disc is secured to a forward end of said rotor to rotate in unison with said rotor and is located in the outboard disc chamber, wherein said outboard disc has a diameter, the diameter of said outboard disc being greater than the diameter of said rotor and said outboard disc is positioned in said outboard disc chamber to be spaced away from surfaces of said pump casing that define the outboard disc chamber.

7. The pump of claim 1, wherein a liner is disposed in said cap and said liner is formed with an interior wall that defines the pump chamber.

8. The pump of claim 1, wherein said rotor and said liner have the same height.

9. The pump of claim 1, wherein:

an inboard housing is disposed in said drive housing; and said shaft is rotatably mounted to said inboard housing.

10. The pump of claim 1, wherein said drive housing and said pump casing are separate components.

11. A suction pump, said suction pump comprising:

a housing, said housing shaped to have: first and second ends; an inboard disc chamber in the first end that has a diameter; a pump chamber in the first end that is located outboard of the inboard disc chamber that is in fluid communication with the inboard disc chamber and that has a diameter less than the diameter of the inboard disc chamber; and inlet and outlet ports in the first end that are in fluid communication with the pump chamber;

an elongated shaft, said shaft being rotatably fitted in the second end of said housing and having a front end adjacent the first end of said housing;

an inboard disc integral with said shaft and located forward of the front of said shaft and the inboard end of said rotor where said inboard disc is disposed in the inboard disc chamber;

a rotor located over the outwardly directed face of said inboard disc and being integral with said shaft and said inboard disc to rotate in unison with said shaft and said inboard disc, said rotor having an inboard and an outboard end, a plurality of outwardly directed slots that extend between the ends of said rotor so said inboard disc closes the inboard ends of the slots and said rotor is located in said pump chamber; and a plurality of vanes, each said vane being located in one of the slots of said rotor so as to rotate in the pump chamber with said rotor.

12. The pump of claim 11, wherein said shaft is shaped to have:

a stem section located distal to said pump casing, the stem section having a diameter; and a head section located adjacent said pump casing, the head section having a diameter that is greater than the diameter of said stem section and wherein said inboard disc is disposed against the head section.

13. The pump of claim 12, further including a bearing assembly for rotatably holding said shaft in said drive housing, said bearing assembly extending from the head section of said shaft to said housing.

14. The pump of claim 11, wherein:

said shaft, said rotor and said inboard disc are separate components; and a fastener urges said rotor towards said shaft so that said inboard disc is compression secured between said shaft and said rotor.

15. The pump of claim 14, wherein:

said shaft is shaped to have a boss that extends forward from the front face of said shaft; and said rotor and said shaft are seated on said shaft boss.

16. The pump of claim 11, wherein:

said housing is shaped to define an outboard disc chamber that is located forward of said pump chamber and that has a diameter greater than the diameter of said pump chamber; and an outboard disc is integral with the outboard end of said rotor to rotate in unison with said rotor and is located in the outboard disc chamber, wherein said outboard disc has a diameter, the diameter of said outboard disc being greater than the diameter of said rotor, the outboard closes the outboard ends of the slots located in the rotor at the outboard end of said rotor and said outboard disc is positioned in said outboard disc chamber to be spaced away from surfaces of said housing that define the outboard disc chamber.

17. A liquid pressure vane pump comprising:

a housing and a pump chamber extending forward from said housing;

a shaft and a bearing assembly rotatably supporting said shaft in said housing;

a rotor in said pump chamber and rotatably supported by said shaft;

said pump chamber having a peripheral wall, said rotor including projectingly movable vanes, said vanes having chamber peripheral wall tracking outer edges, said shaft having a front end face facing forward from said bearing assembly, said rotor being fixed to said shaft for rotation therewith, and located in front of said front end face of said shaft, in which said shaft front end face carries a nose, said rotor having a recess receiving said nose, a fastener extending through said rotor and fixing same with respect to said nose.

18. A liquid pressure vane pump comprising:

a housing and a pump chamber extending forward from said housing;

a shaft and a bearing assembly rotatably supporting said shaft in said housing;

a rotor in said pump chamber and rotatably supported by said shaft;

said pump chamber having a peripheral wall, said rotor including projectingly movable vanes, said vanes having chamber peripheral wall tracking outer edges, said shaft having a front end face facing forward from said bearing assembly, said rotor being fixed to said shaft for rotation therewith, and located in front of said front end face of said shaft;

a casing bounding said pump chamber and in which said housing includes a front portion behind said casing, said shaft has a front end, a disc fixed between said rotor and shaft front end and rotatable with said shaft, said disc being disposed between said housing front portion and casing an axial shaft position adjuster operatively interposed between said shaft and housing for shifting the axial position of said shaft in said housing assembly, said shaft having a first axial position abutting said disc against said casing and a second axial position rearward of said first axial position and spacing said disc between and from said housing front portion and said casing.

19. A liquid pressure vane pump comprising:

a housing and a pump chamber extending forward from said housing;

a shaft and a bearing assembly rotatably supporting said shaft in said housing;

a rotor in said pump chamber and rotatably supported by said shaft;

said pump chamber having a peripheral wall, said rotor including projectingly movable vanes, said vanes having chamber peripheral wall tracking outer edges, said shaft having a front end face facing forward from said bearing assembly, said rotor being fixed to said shaft for rotation therewith, said rotor being located in front of said front end face of said shaft and cantilevered therefrom.

20. The apparatus of claim 19 wherein said housing includes a front bearing assembly, said pump chamber extending forward from said front bearing, said shaft having a motor drivable rear portion and a front portion rotatably supported in said housing assembly by said front bearing assembly, wherein the distance diametrically between opposite sides of said pump chamber peripheral wall approximates the outside diameter of the shaft front portion at said front bearing assembly.

21. The apparatus of claim 19, wherein said bearing assembly comprises a front bearing assembly and including a rear bearing assembly therebehind, said pump chamber extending forward from said front bearing assembly, said rotor having an outer peripheral surface, said rotor having longitudinal slots opening outward through said peripheral surface, said slots having radially inner ends, said rotor having a central portion at said radially inner ends of said slots and from which said slots outwardly extend, said vanes being slidably in said slots and circumferentially along said pump chamber peripheral wall, said rotor being cantilvered forward fron said front bearing assembly, the diameter of said rotor central portion being substantially less than the diameter of said shaft at said front bearing.

* * * * *

UNITED STATES PATENT AND TRADEMARK OFFICE

CERTIFICATE OF CORRECTION

PATENT NO. : 7,134,855 B2
APPLICATION NO. : 10/460973
DATED : November 14, 2006
INVENTOR(S) : William J. Bohr It is certified that error appears in the above-identified patent and that said Letters Patent is hereby corrected as shown below:

Column 12, line 58; change “a pump casing disposed over the front end of said drive housing,” to --a pump casing fixed adjacent the front end of said drive housing--

Column 12, line 60; change “forward from the back face,” to --forward from the shaft front face,--

Column 12, line 61; change “collectively the front end” to --collectively, the front end--

Column 12, line 64; change “disc chamber that surrounds said pump chamber” to --disc chamber that opens to said pump chamber--

Column 13, line 12; change “wherein, said disc” to --wherein said disc--

Column 13, line 23; change “disposed against the head section.” to --disposed axially against the head section.--

Column 13, line 32; change “a fastener urges said rotor towards” to --a fastener urges said rotor rearward towards--

Column 13, line 35; change “said shaft is shaped to have a boss” to --said shaft is shaped to have a nose--

Column 13, line 38; change “said rotor and said shaft are seated on said shaft boss” to --said rotor and said disc are seated on said shaft nose--

Column 13, line 53; change “liner is disposed in said cap” to --liner is disposed in said casing--

Column 14, line 10; change “the inboard end of said rotor where said” to --the inboard end of said inboard disc chamber where--

Column 14, line 28; change “a head section located adjacent said pump casing,” to --a head section located adjacent said pump chamber,--

Column 14, line 34; change “said shaft in said drive housing” to --said shaft in said housing--

Column 14, line 44; change “is shaped to have a boss” to --is shaped to have a nose--

Column 14, line 46; change “said rotor and said shaft are seated on said shaft boss” to --said rotor and said disc are seated on said shaft nose--

UNITED STATES PATENT AND TRADEMARK OFFICE

CERTIFICATE OF CORRECTION

PATENT NO. : 7,134,855 B2
APPLICATION NO. : 10/460973
DATED : November 14, 2006
INVENTOR(S) : William J. Bohr It is certified that error appears in the above-identified patent and that said Letters Patent is hereby corrected as shown below:

Column 14, line 57; change “the outboard closes” to --the outboard disc closes--

Column 15, line 33; change “casing an axial” to --casing, an axial--

Column 15, line 35; change “in said housing assembly” to --in said housing--

Column 16, line 34; change “said vanes being slidably” to --said vanes being slidable--

Column 16, line 35; change “cantilvered forward front” to --cantilevered forward from--

Signed and Sealed this

Third Day of July, 2007

JON W. DUDAS
*Director of the United States Patent and Trademark Office*